United States Patent [19]

Over

[11] Patent Number: 4,907,391

[45] Date of Patent: Mar. 13, 1990

[54] STRUCTURAL SUPPORT MEMBER FOR WINDOW FRAMES OR THE LIKE

[76] Inventor: Helmut Over, c/o Christa Maria u. Helmut Over, Hallstattweg 4, 5352 Zuelpich, Fed. Rep. of Germany

[21] Appl. No.: 209,346

[22] Filed: Jun. 20, 1988

[30] Foreign Application Priority Data

Jun. 20, 1987 [DE] Fed. Rep. of Germany ... 8708611[U]

[51] Int. Cl.[4] ..... E04C 3/30

[52] U.S. Cl. ..... 52/731; 52/732

[58] Field of Search ..... 52/731, 732, 729

[56] References Cited

U.S. PATENT DOCUMENTS 2,633,945 4/1953 Millier ..... 52/729 X 3,483,665 12/1969 Miller ..... 52/282 X

*Primary Examiner*—Carl D. Friedman

*Attorney, Agent, or Firm*—W. G. Fasse; D. H. Kane, Jr.

[57] ABSTRACT

A structural support or connecting member for window frames achieves an improved transmission of forces effective on a window frame, a simplified and less expensive manufacture and installation, an improved reliable sealing against infiltration of water and air, and an improved thermal insulation. In the system a window frame component to be connected to the connecting member has at least one lengthwise extending slot on its side facing support member. The support member or connecting member is assembled of two similar or mirror-symmetrical essentially flat sectional elements (9, 9') attached to each other in a mirror-symmetrical fashion to form two hollow chambers (*7a, 8a*) which extend in parallel to and at a spacing from each other, and which are open laterally through open lengthwise channels (6, 6'). The bar members (9, 9') of the carrier further include at least one engaging flange (10, 11) which can respectively be inserted into and engage the slot (14, 15) of the window frame component (13) in a force transmitting manner.

10 Claims, 2 Drawing Sheets

STRUCTURAL SUPPORT MEMBER FOR WINDOW FRAMES OR THE LIKE

FIELD OF THE INVENTION

The invention relates to a structural support member for frames, such as window frames or the like. A frame component to which the support member is to be attached has at least one slit extending along the length of the frame component on its side facing the support member.

DESCRIPTION OF THE PRIOR ART

Window frames having frame components of the general type described above are commonly known. Such frame components usually are hollow-sections made of plastic reinforced by an inner metal core which is usually also a hollow-sectional element. When several such window frames are to be attached to one another side-by-side along the described frame components, or if a window is to be attached to a house wall in a window opening, for example, the connection first must effectively transmit any arising forces. Secondly, the connection must be water-tight, and thirdly, the connection should be as thermally insulating as possible. In the state of the art, an intermediate, hollow section or solid-section support member is provided between the frame components of adjacent window frames so that these frame components may be screwed against the flat surfaces of this intermediate support member by means of anchor screws or bolts. The lengthwise edges of the conventional intermediate support members protrude beyond the surface of the window frame and may include lengthwise ribs along the sides facing the respective frame components. Corresponding lengthwise edges of a cover cap receive or engage the lengthwise ribs of the protruding edges.

The above described prior art support member or arrangement provides neither satisfactory thermal insulation, nor reliable sealing against moisture or water or even wind. Furthermore, the manufacture and installation of such an arrangement is expensive. While arising forces, for example, the force of wind pressure on the window panes, could be taken up or carried by such a support member, a satisfactory transmission of the forces is not achieved because only a flat friction contact surface is provided for force transmission. Forces are additionally transmitted as shear forces through the tensile anchor bolts only after a corresponding deformation of the window frame components has occurred. Under the application of alternating forces, such a shearing force transmission suggests a considerable looseness of the various components. Reducing the above mentioned looseness to an acceptable level would require expensive and involved measures to be taken regarding the construction of the tensile anchor bolts and the corresponding bored holes. In any event, such looseness or mobility of the components of the window frame would quickly destroy any type of seal.

OBJECTS OF THE INVENTION

In view of the foregoing it is the aim of the invention to achieve the following objects singly or in combination:

- to assure a reliable carrying and transmission of forces in a support member for window frames of the above described type;
- to achieve an improved and continuously reliable sealing against water and air infiltration in windows equipped with the present window frame support member;
- to achieve an improved thermal insulation with such a window frame support member while also providing better mechanical strength, especially with regard to bending loads caused by forces effective perpendicularly to a plane defined by a window pane; and
- to manufacture such a window frame support member in a simpler and less expensive manner and allow simpler installation than required for prior known support members, for example for connecting several frames to each other in a row.

SUMMARY OF THE INVENTION

The above objects have been achieved in a window frame support member, also referred to as frame connecting member, in that according to the invention, the connecting member comprises two similarly shaped essentially flat-section bars which are rigidly interconnected in a mirror image or back-to-back fashion. The assembled support or connecting member includes two hollow chambers extending in the lengthwise direction of the member parallel to each other and with a certain spacing from each other. Each of the hollow chambers is open in a direction perpendicularly to the longitudinal or axial direction so that one lengthwise chamber is accessible from the outside, e.g. of a house and one is accessible from the inside of a room in a house, for example. The support or connecting member further includes at least one engaging flange for each slot of an adjacent window frame component, whereby each engaging flange is inserted into or engages a respective slot of the window frame component to provide a force transmitting coupling between the window frame component or components and the connecting member. The engaging flanges may be formed as bent-over edges of the flat section bars forming the connecting member. Finally, cover caps or plates may engage the lengthwise slots opening into the lengthwise hollow chambers of the connecting member so as to cover the connecting member between two neighboring window frames.

The support or connecting member according to the invention may be very simply and inexpensively produced as a continuous rolled section, since the rolling operation is rather economical. The produced rolled section must merely be cut to the desired length, whereupon the respective pieces are laid lengthwise back-to-back in a mirror image fashion and then rigidly interconnected, for example, by means of spot welding, whereby the present frame connecting member is completely finished. The so produced member may be supplemented in the final installation by adding a cover plate or cap securely snapped onto the connecting member. In order to allow the simple attachment of such a cover plate or cap, the cover plate or cap includes a web or central flange having a bent or rolled outer edge which may be inserted into the above-mentioned lengthwise slots to engage the hollow chambers of the connecting member. The major portion of the web or flange of the cap is guided or supported by the walls of the lengthwise slot leading to each hollow chamber.

The above named engagement flanges of the support member each reach into a slot of the adjacent frame component of the window frame and are arranged so that they respectively tightly contact a corresponding side surface of the corresponding slot so as to achieve a form-fitting and force transmitting connection of the frame component with the support member, especially in the lengthwise bending or kinking direction of the window frame component. Thus, as described, this connection is advantageously a very simple plug-in connection.

The previously necessary tension anchors or screws for attaching the window frame component to an adjacent carrier no longer must transmit any shearing forces. Therefore, this screw connection may correspondingly be made much simpler and lighter in its construction. In some instances the screw connection may even be omitted.

Furthermore, in the device according to the invention, it is quite simple to achieve a reliable and durable seal, such as a rubber seal strip, between each engagement flange and the corresponding slot of the window frame component. Such a sealing strip must only allow a minimal movement, if any at all, of the window frame relative to the carrier. Furthermore, an additional reliable seal against moisture and air infiltration may independently be arranged between the edges of the cover plate or cap and the respective corresponding surface of the window frame component. Thus, any penetration or infiltration of moisture or air is reliably prevented. Simultaneously, a good thermal insulation or shielding is achieved because the metal components of the support member are closed-in or encapsulated on all sides. Therefore, no thermally conducting bridge exists through the entire thickness of the support or connecting member according to the invention.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
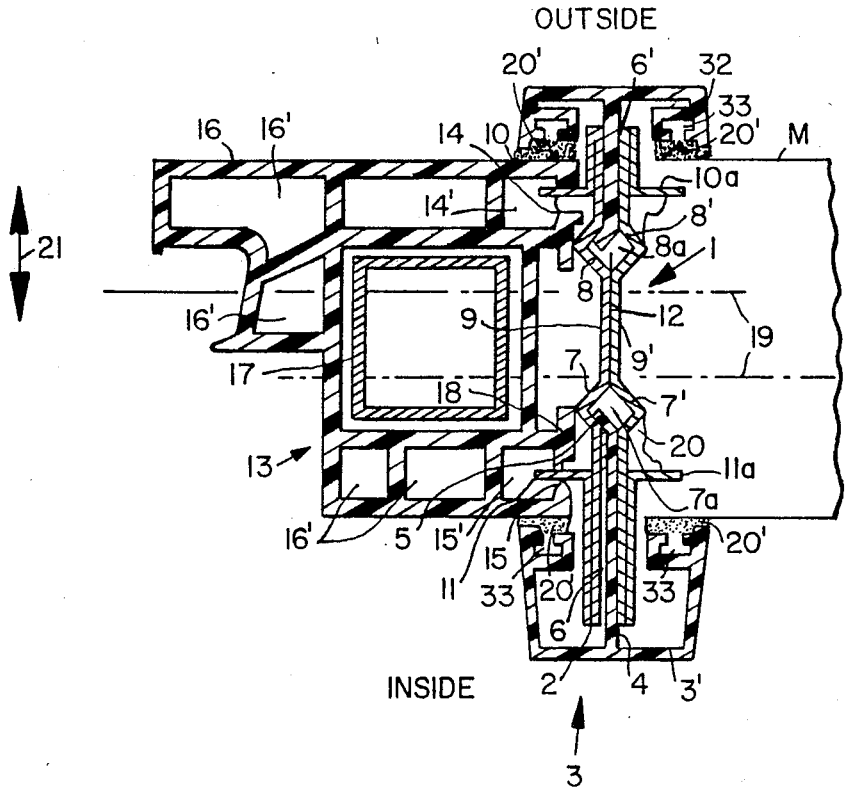
FIG. 1 shows a cross-section through a window frame component with a support member or connecting member according to the invention.
Figure 2:
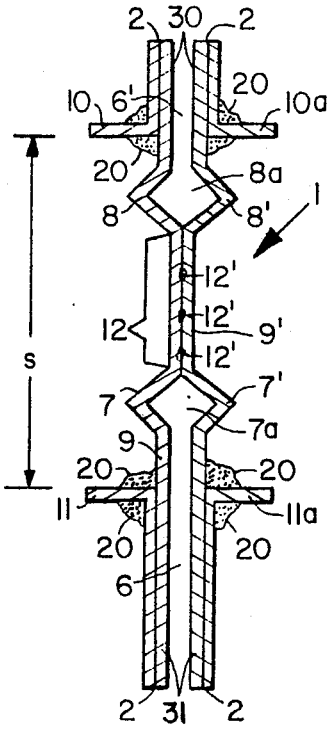
FIG. 2 is a sectional view similar to that of FIG. 1, but showing the support member of the invention independently of its connection to a frame component.

Referring to FIGS. 1 and 2 in conjunction, the present support or connecting member 1 is made of initially flat, rolled stock to form two sectional elements 9 and 9' to be described in more detail below. The cross-sectional view of FIG. 1 shows a frame component 13 of a window frame which is not shown in further detail. The "outside" of a building is assumed to be above the frame and the "inside" is assumed to be below the frame. The frame component 13 preferably comprises a plastic hollow section 16 having several lengthwise extending hollow chambers 16' and an inner stabilizing metal core 17 which is preferably also a hollow-section element, e.g. of aluminum. Along the lateral edges of the window frame, the frame component 13 includes slots 14 and 15 extending lengthwise, that is in the direction perpendicularly to the drawing. The slots 14, 15 have a spacing S from each other and run parallel to each other. The slots 14 and 15 open respectively into hollow chambers 14' and 15' of the plastic hollow-section 16. The support member or connecting member 1 is arranged immediately next to the frame component 13, that is, to the right of the frame component 13 as shown in the drawing. Another frame component would be arranged in a mirror-symmetrical fashion to the right of the support or connecting member 1, but is not shown in FIG. 1. Alternatively, a structural member M, for example a wall forming a window opening in a building, would be located to the right of the connecting member 1.

The supporting member 1, according to the invention, is assembled by using two initially flat sectional elements 9 and 9' which have been cut to the appropriate length and shaped and pleated as best seen in FIG. 2, e.g. by a rolling operation. The shaped and pleated sectional elements 9 and 9' are laid back-to-back against one another in a mirror image fashion and are then rigidly attached to each other along a contact zone 12. The connection is accomplished, for example, by means of spot welding 12' or rivets or the like. The contact zone 12 is formed between the two lengthwise extending hollow chambers **7*a* and 8*a* formed due to the pleating. Each sectional element 9 or 9' itself may initially be formed as a rolled section having rolled-in corrugations or pleats 7 and 8, or 7' and 8' respectively, extending whereby the length of the pleats perpendicularly to the plane of the drawing sheet extends to parallel in the lengthwise direction. Furthermore, outer end edges or end sections 30, 31 of the sectional elements 9 or 9' extending laterally beyond the pleats 7 and 8 or 7' and 8' are not in the same plane as the central contact zone 12 so that when the sectional elements 9 and 9' are interconnected back-to-back, lengthwise channels 6 and 6' are formed between the outer lateral end edges or sections 30, 31 of the sectional elements 9 and 9' to open into the hollow chambers 7*a* and 8*a* through a lengthwise gap formed between the pleats 7 and 7', and 8 and 8', respectively. Engaging flanges 10, 10*a*; 11, 11*a* are formed either during the initial continuous rolling process, or alternatively in a separate operation performed on the cut-to-length sectional elements 9 and 9'. The flanges 10, 10*a*; 11, 11*a* are formed by folding over by 180° an appropriate width of the outer end edges or sections 30, 31 of the bars sectional elements 9 and 9' and then bending by 90° a strip along the edge, to form the respective engaging flange 10, 10*a* or 11, 11*a*. Either the 180° folding or the 90° bending may be carried out as a first step, while the other respective bending or folding is carried out as a second step. It is also possible that separate engaging flange members could be attached to the sectional elements 9 and 9', for example by welding. The flanges 10, 11 are held in the slots 14, 15 of the frame component 13 respectively. The flanges 10*a*, 11*a* fit into a respective frame component 13** or structural member M.

In the arrangement shown, the engagement flanges 10 and 11 are received in the corresponding slots 14 and 15 of the frame or sash component 13 with a tight fit. It is necessary that the width of the slots 14, 15 and the thickness of the flanges 10, 11 and the spacing S between the flanges, which is also the spacing between the slots are properly correlated to assure a snap-in fit. In this context, it may be advantageous that the engaging flanges 10 and 11 tightly contact at least one side of the respective slot 14 and 15 of the frame component 13. The remaining free space between the other slot wall of the slots 14 and 15 and the inserted engaging flanges 10 and 11 may be filled with an appropriate sealing material 20 which may be carried by the flanges 10, 11; and 10*a*, 11*a*. The spacing between, and the position of, the hollow chambers 7*a* and 8*a* may be chosen so that an inner flange 18 of the plastic hollow section 16 of the frame component 13 comes into contact with the pleats 7 and 8 or 7' and 8' which form the hollow chambers 7*a* and 8*a*. Then, screws may be screwed in along the axes 19 to pull the inner flange 18 of the hollow section 16 tightly against the pleats 7 and 8 as shown. The screws along axes 19 may actually extend through the frame component 13 and through the support member 1. In this manner, the hollow-section 16 is connected to the support or connecting member 1 in a form-fitting and force-transmitting manner, especially by means of the engaging flanges 10 and 11 in the slots 14 and 15. Thus, any bending or movement of the hollow section 16 in the direction of arrow 21 is not possible, or at least substantially impeded by the member 1.

In order to achieve a high strength in the engaging flanges 10 and 11, and in the entire connecting member 1, it is preferable to roll-form the bars sectional elements 9 or 9' of sheet steel. Furthermore, such a construction allows a reduction of the material costs.

As described above, the back-to-back or mirror-symmetrical arrangement of the two sectional elements 9 and 9' forms two lengthwise extending channels 6 and 6' which open from the narrow edges 2 of the connecting member 1 into the lengthwise extending hollow chambers 7*a* and 8*a* respectively. A cover plate or cover strip 3 essentially comprises a lengthwise extending cap 3' and a lengthwise extending inner web of flange 4 attached to the inside of the cap 3'. A lengthwise edge 5 of the central flange 4 opposite the cap 3' is bent or rolled over along an appropriate small width. In order to cover the region of the interconnection between two adjacent window frames, or more particularly, to cover the connecting member 1 according to the invention, the central lengthwise flange 4 of the cover strip 3 is inserted into the respective lengthwise channel 6 or 6' of the member 1. Thus, the bent over or rolled over lengthwise edge 5 of the lengthwise flange 4 reaches into and engages behind a wall portion of the respective pleats 7, 8; 7', 8' forming the hollow chamber 7*a* or 8*a* respectively. The pleat wall portions slant away from the respective channel 6, 6' to securely hold the bent over edge of the cover strip 3 in place. A caulking or sealing strip 20' may be provided between the edges of the cap 3' of the cover strip 3 and the respective adjacent surfaces of the window frame member 13 in order to provide an additional seal against infiltration of moisture and air.

The cap 3, 3' is fairly deep in the direction of the arrow 21. Hence, the edges or legs 31 are also relatively long. The length of the cap 3, 3' in the direction perpendicularly to the sheet of the drawing may have any desired dimension as required by the respective window dimension.

The cap 32 is shorter in the direction of the arrow 22 than the cap 3. Hence, the edges or legs 30 are also relatively short. Both types of caps may have recessed channels 33 for holding caulking material 20' as shown in FIG. 1.

Figure 3:
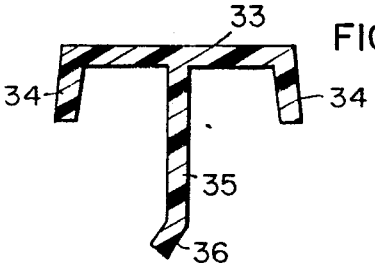
FIG. 3 is a sectional view through a modified cover cap strip.

FIG. 3 shows another cover cap strip 33 which is relatively flat due to its short lateral rims 34, which may be shaped to hold caulking. The stem 35 will have a length suitable to the fit into the respective channel 6' or 6. The bent-over edge 36 is flexible enough to pass through the channel and then snap-in place in the respective chamber 7*a*, 8*a*.

The support member or connecting member 1 according to the invention may be produced very inexpensively, especially when sheet metal is used. The member is easy to handle and install, achieves a simplification of connecting adjacent window frames, achieves good form stability and force transmission with the frame components 13 of a corresponding window frame. Furthermore, the cap 3 achieves a reliable sealing against water and air infiltration, and an improved thermal insulation. The type of cover cap may be selected in accordance with different frame dimensions or configurations.

Although the invention has been described with reference to specific example embodiments, it will be appreciated, that it is intended to cover all modifications and equivalents within the scope of the appended claims.

What I claim is:

1. A support member for connection to a structural frame component, such as window frame components having at least one lengthwise slot (14, 15) facing said support member (1), comprising two sectional elements (9, 9') each having two pleated sections (7, 8; 7', 8'), a flat intermediate section (12) between said pleated sections, and an end section (30, 31) away from each pleated section and outside each pleated section, means (12') interconnecting said two sectional elements along said flat intermediate section (12) lengthwise in a mirror image arrangement, said pleated sections forming two lengthwise extending hollow chambers (7*a*, 8*a*), each hollow chamber having an open lengthwise gap between its pleated sections, said end sections (30, 31) extending in parallel to each other in pairs to form two lengthwise extending channels (6, 6'), each channel opening laterally from the outside into a respective hollow chamber (7*a*, 8*a*) through said lengthwise gap, said sectional elements (9, 9') further comprising at least one engaging flange (10, 11) insertable into said lengthwise slot (14, 15) of said frame component (13) for engaging said slot (14, 15) in a force transmitting manner.

2. The support member of claim 1, wherein each flat intermediate section of said sectional elements (9, 9') comprises a contact region (12) between said lengthwise extending hollow chambers (7*a*, 8*a*), said interconnecting means (12') securing said sectional members rigidly to each other along said contact region.

3. The support member of claim 1, wherein said hollow chambers (7*a*, 8*a*) comprise an angular cross-section, so that wall portions of respective pleats (7, 8; 7', 8') are slanting away from the respective channel (6, 6'), whereby a bent over edge of a cover strip can engage behind said slanting wall portions for securing said cover strip to said support member.

4. The support member of claim 1, wherein said engaging flange (10, 11) is a bent lengthwise edge of said end sections of the respective sectional element (9, 9'), said bent lengthwise edge of said end sections extending perpendicularly to the respective end section.

5. The support member of claim 4, wherein said lengthwise edge of said end sections of said sectional element (9, 9') comprises a folded over portion and a bent portion forming said engaging flange (10, 11; 10*a*, 11*a*), said folded over portion extending in parallel to the respective end section, so that four wall portions extend in parallel to each other where said end sections are formed for stiffening said support member in planes extending in parallel to a plane defined between said intermediate sections.

6. The support member of claim 1, wherein each of said pleated sections of said sectional elements is arranged directly opposite the respective other sectional element for forming said hollow chambers (*7a, 8a*).

7. The support member of claim 1, further comprising a cover strip (3) arranged along each narrow edge of said support member, said cover strip comprising a lengthwise extending cap (3') and a centrally located web (4), whereby said web (4) is insertable into a respective one of said channels (6, 6') with a snap fit.

8. The support member of claim 7, wherein said web (4) has a lengthwise bent edge (5) engaging a slanted wall of the respective hollow chamber with a snap-fit.

9. A frame system, comprising at least one structural frame component having at least one lengthwise slot facing a neighboring structural component, a connecting member connected to said at least one structural frame component, said connecting member comprising two sectional elements (9, 9') each having two pleated end sections and a flat intermediate section between said pleated end sections, means interconnecting said two sectional elements along said flat intermediate section lengthwise in a mirror image arrangement, said pleated end sections forming two lengthwise extending hollow chambers (*7a, 8a*), and two lengthwise extending channels (6, 6') each opening laterally from the outside into a respective hollow chamber (*7a, 8a*), said sectional elements (9, 9') further comprising at least one engaging flange (10, 11) insertable into said lengthwise slot (14, 15) of said frame component (13) for engaging said slot (14, 15) in a force transmitting manner.

10. The frame system of claim 9, wherein said structural frame component comprises at least one hollow channel, said lengthwise slot reaching into said hollow channel.

* * * * *